United States Patent [19]

Rodland

[11] 4,137,758

[45] Feb. 6, 1979

[54] TORQUE INDICATOR APPARATUS

[76] Inventor: Arild Rodland, Stavsvei 30 A, Trondheim, Norway, 7000

[21] Appl. No.: 865,493

[22] Filed: Dec. 29, 1977

[51] Int. Cl.[2] ..... B25B 23/14

[52] U.S. Cl. ..... 73/139; 73/143

[58] Field of Search ..... 73/139, 143; 81/52.5; 173/12

[56] References Cited

U.S. PATENT DOCUMENTS

| | | | |
|---|---|---|---|
| 2,765,654 | 10/1956 | Greer et al. | 73/141 R |
| 3,589,179 | 6/1971 | Nicolan | 73/139 |
| 3,693,727 | 9/1972 | Bell | 173/12 |

*Primary Examiner*—Charles A. Ruehl
*Attorney, Agent, or Firm*—David M. Ostfeld

[57] ABSTRACT

A torque indicating attachment for a pipe tong arm is disclosed. The attachment comprises support means releasably connected to the arm and a toggle pivotally connected to the support means. The toggle includes a second toggle link oriented radial to the center of the pipe gripping means of the pipe tong and a first toggle link oriented perpendicular to the line from the center of the pipe to the pivot point of the pivotal connection of the second toggle link to the support means. The first toggle link includes an electro-mechanical transducer connected to a visual and sonic readout galvonometer.

17 Claims, 5 Drawing Figures

34
23
51
31
29
21
19
25
27
35
42
45
17
33
47
43
36
90°
41
11
13
37
15
49
53
110 V. AC 41
34
19'
31
35
47
27'
45
33
29
43
36
90°

23
31
27
90°
36
29

TORQUE INDICATOR APPARATUS

BACKGROUND OF THE INVENTION (a) Field of the Invention

This invention relates to tongs used, for example, in the drilling industry for connecting and disconnecting lengths of pipe, e.g. drill pipe, and more particularly to an attachment for such a tong incorporating means to measure the torque being applied through the tong when a force is applied to the tong arm by means of a cable or rope.

(b) Description of the Prior Art

By definition, the torque applied through a tong is the product of the force applied, i.e. the tension in the line, and the moment arm, which is the perpendicular distance between the center of the pipe being connected and the line of action of the force It is known to incorporate a tension indicator in the cable to indicate the force being applied to the tong arm. However, because of the change of position of the tong arm as the pipe is turned, the length of the moment arm as above defined changes, being equal to the length of the connection line, i.e. the line from the center of the pipe to the point of connection of the cable to the tong arm only when such connection line is perpendicular to the cable. In general, the moment arm is equal to such distance multiplied by the sine of the angle (X) between the cable and the connection line.

It is desirable to provide a device overcoming the problem of the variation of the angle (X), whereby torque is correctly indicated by a force measuring device regardless of the angle (X). A search of certain areas of classification of United States patents revealed the following U.S. patents as relevant to the problem:

U.S. Pat. No. 2,183,633 — Zimmermann,
U.S. Pat. No. 2,801,539 — Swenson,
U.S. Pat. No. 3,589,179 — Nicolau,
U.S. Pat. No. 3,693,727 — Bell.

The Zimmerman patent discloses a wrench employing two arms, both to be positioned with one end centered on a nut to be turned but extending in different directions, with a force indicator therebetweeen perpendicular to one arm. Force applied at any angle to the other arm is transmitted perpendicularly through the force indicator to the one arm. However, as the spring type force indicator employed shortens with application of force, the force indicator is no longer precisely perpendicular to the one arm so that the force indicator scale needs to be nonlinear in order to indicate torque.

The Swenson patent shows pipe tongs and cable with a force measuring unit in the cable. The cable end connected to the tongs passes over an arcuate support mounted on the tongs, whereby the angle between the cable and the connection line is constant, so that a torque gage connected to the force measuring unit can be linearly calibrated. The angle through which the tongs can be turned while the torque gage gives a correct reading is limited by the length of the arcuate support.

The Nicolau patent shows a pipe tong to be actuated by a cable and incorporating a torque indicator which gives a true torque indication regardless of the cable's angle to the tong arm. This is achieved by passing the cable through an eye in the torque arm, the end of the cable then extending perpendicular to the arm to a force measuring unit, so that only the component of cable tension perpendicular to the arm is applied to the force indicator. To compensate for the reaction of the tong at its eye where the cable passes through, the force measurer is mounted so that the torque effective component of the reaction force is also applied to the force measuring unit. The mounting of the force measuring unit includes relatively movable yoke and U shaped support members which must remain free to move in order that the torque indicator will give correct readings.

The Bell patent shows a pipe tong to which force is applied by a cable and which includes a torque indicator. To overcome the problem of variable angle between cable and tong, a special connection between them is employed. A lever is pivotally mounted on the tong arm. The cable is attached to one end of the lever. A load cell is positioned between the other end of the lever and the tong with the load cell axis perpendicular to the lever arm. It is said that the load cell measures the true torque applied to the lever and since the tong torque must be equal and opposite, the load cell measures the true torque applied to the tong arm.

It will be seen that all of the foregoing U.S. patents which are intended to give a linear indication of torque involve a mounting including some form of relatively moving parts, i.e. a sector on which the cable winds (Swenson), relatively slidable yoke and U shaped members (Nicolau), and a pivotally mounted lever (Bell).

It is an object of the present invention to provide a torque indicator for attachment to a tong arm that will give a correct reading independent of the angle of the cable employed to apply force to the tong arm and which will be inexpensive to manufacture and simple and reliable in operation, involving few moving parts.

SUMMARY OF THE INVENTION

According to the invention, there is provided a true torque indicator unit for attachment to or manufacture integral with a pipe tong. The unit comprises a U section attachment bracket adapted to encompass a tong arm and to be secured thereto. A support tube lying in the open side of the bracket and closing same about the tong arm is releasably secured to the bracket by bolts. A gusset plate welded to the tube extends in a direction away from the tube and bracket perpendicular to the tong arm. A pair of bars are each pivotally connected at one end to the upper and lower sides respectively of the end of the plate. The other ends of the bars are pivotally connected to the ends of a U shaped bar forming means for making connection to a cable. The two bars form one link of a toggle. The other link of the toggle is provided by a transducer pivotally connected at one end to the tube and at the other to the two bars where they join the U shaped bar. The transducer is of the type that converts force to an electric signal. Preferably the toggle link formed by the transducer is disposed with its axis perpendicular to the radius from the center of the pipe gripping means of the tong to the point of connection of the transducer to the tong arm, so that all force transmitted to the tong arm by the transducer creates torque. The toggle link formed by the two bars lies on a radius from the center of the pipe gripping means of the tong, so that the force transmitted by the bars to the tong arm exerts no torque. In other words, the toggle divides the force of the cable applied to the tong arm into two components, with the entire component perpendicular to the connection line (moment arm) being applied through the transducer. The transducer converts force to an electric signal to give an indication of the torque applied by the tong arm which is correct regardless of the angle of the cable. Variations in the toggle angles with applied force are minimal due to the fact that the force-to-electric signal transducer, e.g. a strain gage welded onto a solid steel body, responds to a wide range of force with a change of dimensions of only molecular magnitude, and also due to the fact that the toggle link formed by the two bars is short compared to the transducer link, e.g. less than half the length, whereby even a large change in length of the transducer would not shift it far from perpendicularity to the moment arm.

BRIEF DESCRIPTION OF THE DRAWINGS

For a further understanding of the nature and objects of the present invention, reference should be made to the following detailed description, taken in conjunction with the accompanying drawings, in which like parts are given like reference numerals and wherein.

The parts are all made of steel except for the transducer and electrical instrument connected thereto, and the usual convention for showing metal in elevation and in section have been employed.

DESCRIPTION OF PREFERRED EMBODIMENT

Figure 1:
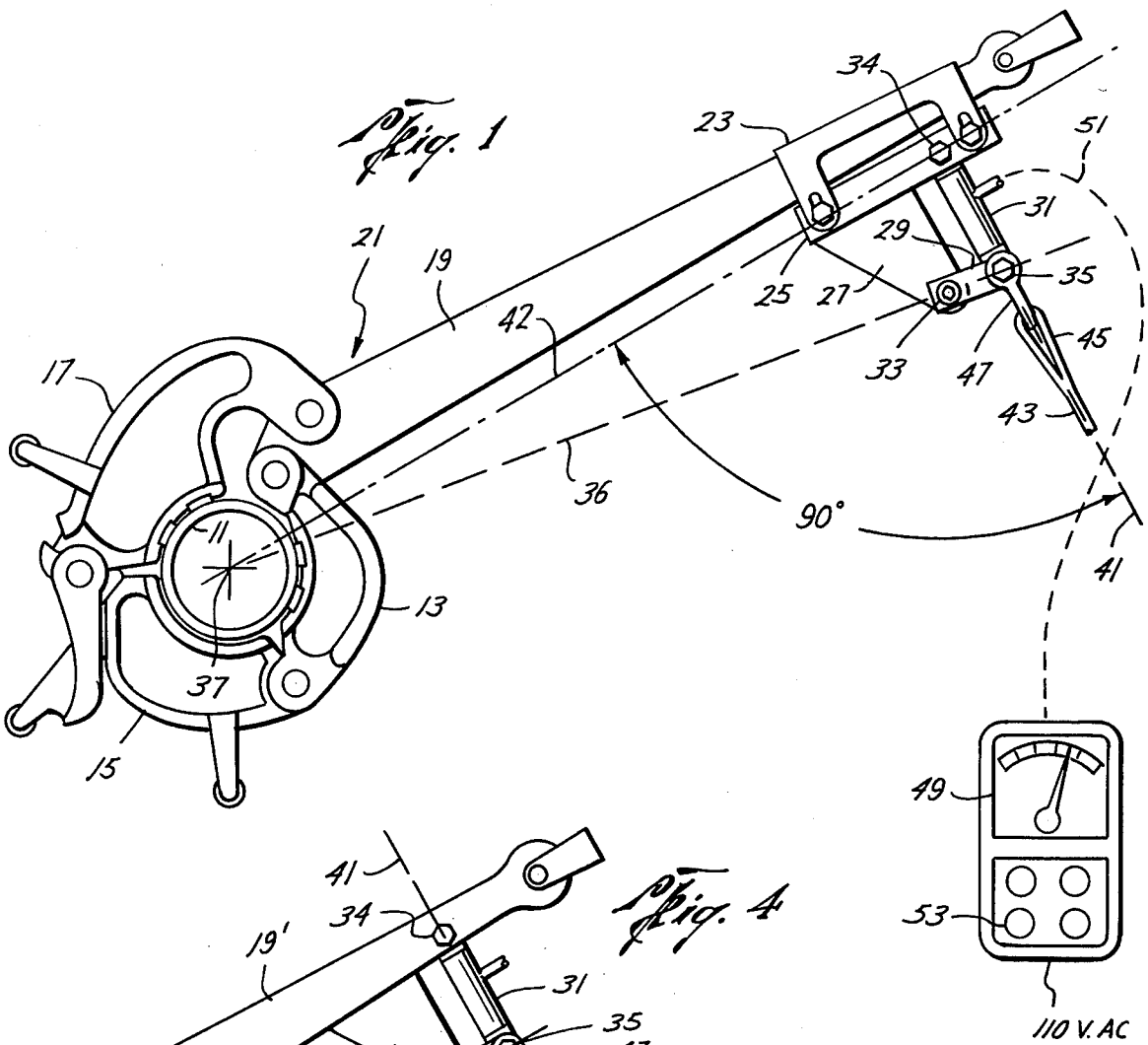
FIG. 1 is a plan view of the invention applied to a tong arm.
Figure 2:
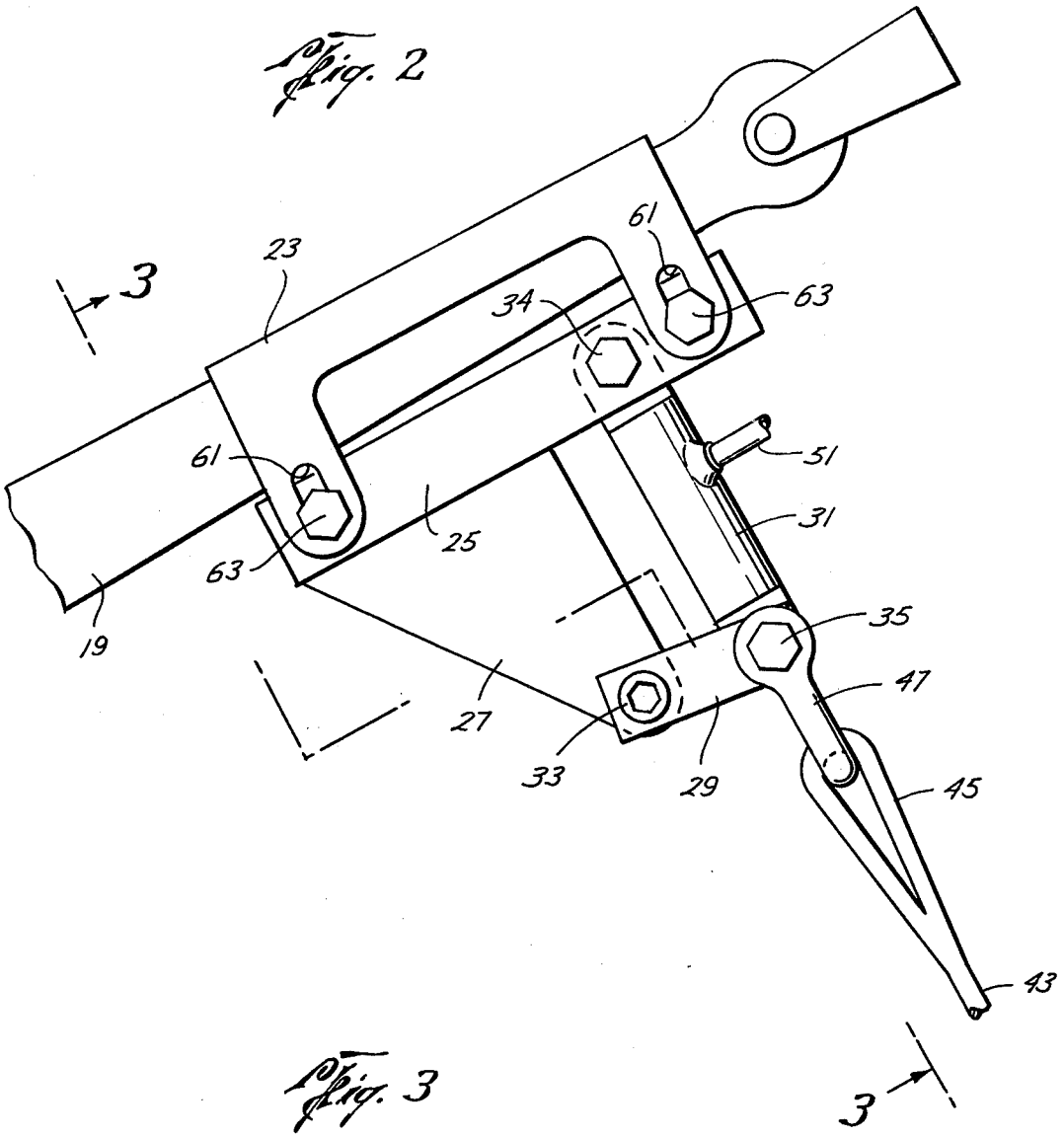
FIG. 2 is a plan view of the invention similar to FIG. 1 but to a larger scale.
Figure 3:
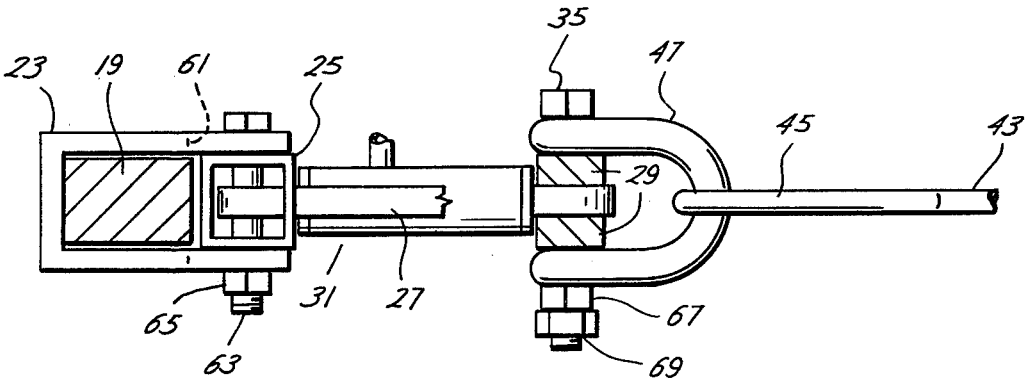
FIG. 3 is a section taken at 3—3 of FIG. 2.

Referring now to FIGS. 1–3, especially FIG. 1, there is shown a pipe 11 to which is applied the gripping means 13, 15 and 17 on one end of arm 19 of pipe tong 21.

A torque indicator unit according to the invention includes support means having a U shaped support bracket 23 secured about arm 19 and support tube 25 bolted thereto. A gusset support plate 27 is welded to the tube. A force dividing toggle is attached to the support means. The toggle includes a short link comprising two bars 29 (see also FIG. 2) pivotally connected at 33 to plate 27. The toggle also includes a second link having a force-to-electric signal transducer 31. One end of said force-to-electric signal transducer 31 is pivotally connected at 35 to the other ends of bars 29, and the other end of the transducer is pivotally connected at 34 to the support tube.

As indicated by broken line 36, the center 37 of pipe 11, and of the gripping means 13, 15, 17 when in the closed position around the pipe 11, and the centers 33, 35 (see FIG. 2) of the pivotal connections of bars 29 with plate 27 and transducer 31, are in alignment. The axis of transducer 31, indicated by broken line 41, is at right angles to the connection line indicated by broken line 42, the connection line being a line through pipe gripping means center 37 and pivot 34, the latter being the point of application of force to the tong arm.

A rope or cable 43 has an eye 45 (see FIG. 3) connected to U shaped bar 47. Bar 47 is pivotally connected at 35 to the juncture of transducer 31 and bars 29. By this means, force can be applied to the tong arm. The resulting torque is visually indicated by galvanometer 49 connected by electric cable 51 to transducer 31. A sounder 53 connected to the galvanometer can be set to sound whenever a desired torque is achieved or exceeded.

Referring now particularly to FIGS. 2 and 3, in order to allow bracket 23 and support tube 25 to both grip arm 19 tightly, the four openings 61, (only three are visible in the drawings) through which pass attachment bolts 63 are elongated to allow for adjustment. This insures that the line through the axes of pivots 33, 35 will be properly positioned to pass through center 37 of the closed pipe gripping means 13, 15, 17. It is the dimensioning of bars 29, plate 27, tube 25, and transducer 31 which determine the position of the center of pivot 35 relative to the center of pivot 34 so that the line joining centers 34, 35 is perpendicular to the line joining centers 34, 37, as required to effect the desired resolution of the force from the third toggle link provided by U shaped bar 47.

It is to be noted that while support bracket 23 and support tube 25 are tightly held together by bolts 63 and the four nuts 65 (only one appears on the drawings) screwed thereon, nut 67 on pivot bolt 35 and the like nuts (not appearing in the drawings) screwed onto pivot bolts 33, 34, do not bind bars 29 and transducers 31 to plate 27 and tube 25, whereby the transducer and bars transmit forces along their lengths, but no bending moment. Any desired means can be employed to keep the relatively loose nuts from coming unscrewed, e.g. lock nuts 69 may be employed.

While a preferred embodiment of the invention has been shown and described, modifications thereof can be made by one skilled in the art without departing from the spirit of the invention.

Figure 4:
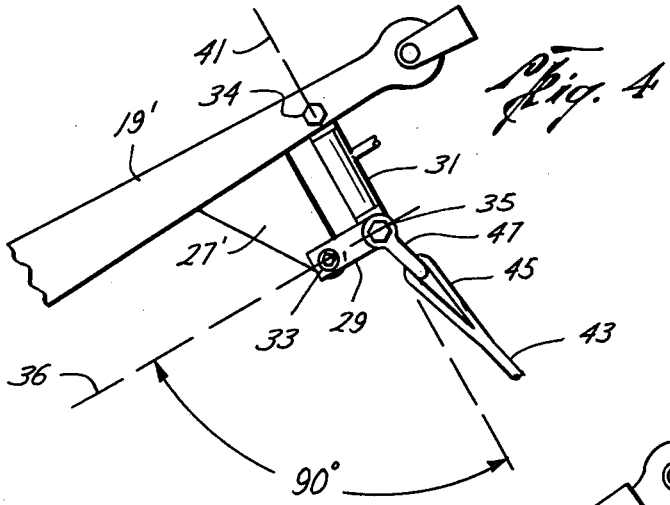
FIGS. 4 and 5 are fragmentary views similar to FIG. 2 showing modifications.

Referring now to FIG. 4, the support bracket 23 and support tube 25 could be omitted and plate 27' and transducer 31 could be secured directly to tong arm 19, thereby making the tong and torque indicator one assembly. To avoid repetition of the description, in FIG. 4 like parts are given the same reference number as in FIGS. 1–3, and analagous parts are given the same reference number except primed. The operation is the same.

While the transducer axis is preferably at right angles to the connection line 42, this is not essential. For example, as shown in FIG. 4, if the axis 41 of transducer 31 was disposed at right angles to centers line 36, the force measured by transducer 31 would include a component directed radially through pipe gripper center 37. Such component exerts no torque on the pipe. However the ratio of such component to the torque exerting component perpendicular to the connection line would be constant and independent of the cable angle. Therefore, the galvanometer could be calibrated to read true torque independent of the cable angle.

Figure 5:
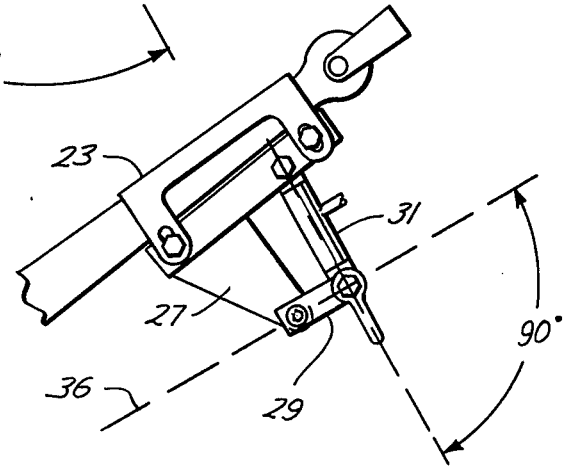

It will be apparent therefore, that, in the FIGS. 1–3 embodiment, the disposition of transducer axis 41 could be as in FIG. 4 or any other desired angle. This is illustrated in FIG. 5. The angle shown in FIG. 1 is preferable, however, because it minimizes the required force transmitting capacity of the transducer. For this reason, the FIG. 1 disposition of transducer 31 would be preferable also in the FIG. 4 embodiment.

In view of the large forces employed in making up drill pipe connections and the minimal movement of the links 29, 31 of the force dividing toggle, it will be apparent that any slight friction at pivot points 33, 34, 35 of the toggle such as would occur if the nuts 67 were drawn up fairly tight on bolts 33, 34, 35 would have little adverse effect, since not much torque would be transmitted by such friction compared to the large torque applied to the tong arm. It is also to be noted that the transducer can pivot freely regardless of the degree of make up of the nuts on pivot bolts 34, 35, since the bolt tension is taken by tube 25 and U bar 47 respectively.

Although the preferred embodiment and preferred method of operation as described in detail have been found to be most satisfactory, many variations in structure and method are possible. For example, it will also be apparent that cable attachment U bar 47 could be omitted and cable eye 45 applied directly about pivot bolt 35. However, it is preferred to employ a link such as U bar 47 for pivotally applying force to force dividing toggle 29, 31 at pivot 35.

Because many varying and different embodiments may be made within the scope of the inventive concept taught herein and because many modifications may be made in the embodiment herein detailed in accordance with the descriptive requirements of the law, it should be understood that the details herein are to be interpreted as illustrative and not in a limiting sense.

What is claimed as invention is:

1. Apparatus useful with means for indicating torque applied to a pipe by a tong having an arm, tension force being applied to the arm by a cable, said apparatus comprising: first and second force dividing links pivotally connected together at a first end of each of said force dividing links by pivot means and extending in different directions radially therefrom, said pivot means having means for attachment to the cable to apply the tension force of the cable to said pivot means, said force dividing links having connection means at a second end of each of said force dividing links for transmitting the tension force to the arm of the tong and for dividing the tension force applied to said pivot means into components, said first of said force dividing links including a transducer means for converting force to electric signals.

2. Apparatus according to claim 1, wherein: link to said connection means and to said first force dividing link being said connection means includes support means for mounting on the tong arm with the length of the tong arm extending in a certain direction relative to the support means, and pivotal connections connecting said force dividing links to said support means; and the line between the pivot center of said pivotal connection of said second force dividing link to the support means and the pivot center of said pivotal connection of said second force dividing link with said first force dividing link being directed to intersect said certain direction at a point corresponding to the center about which torque is to be applied by the tong.

3. Apparatus according to claim 2 wherein said pivot means includes a third link pivotally connected to said force dividing links, said third link including said means for attachment of the cable to said pivotal connection of said force dividing links.

4. Apparatus according to claim 3 wherein said transducer means is disposed with its axis perpendicular to a line joining the center of torque application and the center of said pivotal connection of said first ends of said force dividing links.

5. Apparatus according to claim 3, wherein said support means includes a U shaped bracket having means for passing about the tong arm and a tubular bar having means for being bolted to said bracket to close the open side thereof after placement of said support means about the tong arm.

6. Apparatus according to claim 5, wherein said support means including a gusset plate connected to and extending from said tubular bar away from said bracket, said pivotal connection of said first force dividing link to said support means being effected at said tube, said pivotal connection of said second force dividing link to said support means being effected at said gusset plate.

7. Apparatus according to claim 6, wherein said second force dividing link includes two bars disposed on opposite sides of said gusset plate and on opposite sides of said first end of said first force dividing link.

8. Apparatus according to claim 5, wherein said U shaped bracket includes slots in the sides of said bracket to receive bolts for securement of said support tube, said slots providing for adjustment so that said support means can be fitted snugly to the tong arm.

9. Apparatus according to claim 2 wherein said transducer means is disposed with its axis perpendicular to a line joining the center of torque application and the center of said pivotal connection of said first force dividing link to said support means.

10. Apparatus according to claim 9 wherein the length of said first force dividing link between its said pivotal connections is over twice the length of said second force dividing link between its said pivotal connections.

11. Apparatus according to claim 1 wherein the tong has pipe gripping means at one end of the arm for gripping the pipe and wherein said force dividing links are pivotally connected to the arm by said connection means, the pivot centers of the pivotal connection of said second force dividing link being aligned with the center of the pipe gripping means.

12. Apparatus according to claim 11 wherein the pivot centers of the pivotal connections of said first force dividing link to the arm and to said second force dividing link are perpendicular to the line through said center of the pipe gripping means and the pivotal connection of said first force dividing link to the arm.

13. Apparatus according to claim 12, wherein said connection means includes support means and said force dividing links are pivotally connected to the arm by said support means disposed about the arm, said force dividing links being pivotally connected to said support means.

14. Apparatus according to claim 13, wherein said pivot means includes:

a third link pivotally connected to said pivotal connection of said first ends of said force dividing links, said third link having means for attachment of the cable to said pivot means.

15. Apparatus useful to indicate torque being applied to a pipe by a tong having an arm, tension force being applied to the arm of the tong by a cable, said apparatus comprising:

an attachment connected to the arm having a first pivot and a first link, said first link being attached to said first pivot;

a second link pivotally connected to said first link at a second pivot, said second link oriented radially with respect to the pipe, said second pivot having means for attachment to the cable to apply the tension force of the cable to said second pivot and said second link having connection means for connection to the arm;

said links having means for dividing the force of the cable into components, said first link including a transducer means to convert force to electric signals.

16. The apparatus of claim 15 wherein said means for dividing the force of the cable into components divides the force into orthogonal components.

17. The apparatus of claim 15 wherein said connection means connects said second link to said attachment, said attachment and said connections of said links to said attachment transmitting force to the arm of the tong.

* * * * *

UNITED STATES PATENT OFFICE

CERTIFICATE OF CORRECTION

Patent No. 4,137,758 Dated February 6, 1979

Inventor(s) Arild Rodland

It is certified that error appears in the above-identified patent and that said Letters Patent are hereby corrected as shown below:

Column 1, line 18, after "force", insert a period -- . --.

Column 5, line 38, after "wherein:", delete "link to".

Column 5, line 39, delete the entire line.

Column 5, line 40, delete "link being".

Column 6, line 40, after "link", insert -- to said connection means and to said first force dividing link --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*